US010060233B2

(12) United States Patent
Albers et al.

(10) Patent No.: US 10,060,233 B2
(45) Date of Patent: Aug. 28, 2018

(54) HYDRAULIC TUBING PERFORATOR

(71) Applicant: Halliburton Energy Services, Inc., Houston, TX (US)

(72) Inventors: Robert Wayne Albers, Waxahachie, TX (US); Jason Karl Cook, Crowley, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 252 days.

(21) Appl. No.: 15/024,293

(22) PCT Filed: Nov. 1, 2013

(86) PCT No.: PCT/US2013/068027
§ 371 (c)(1),
(2) Date: Mar. 24, 2016

(87) PCT Pub. No.: WO2015/065471
PCT Pub. Date: May 7, 2015

(65) Prior Publication Data
US 2016/0237793 A1 Aug. 18, 2016

(51) Int. Cl.
*E21B 43/112* (2006.01)
*E21B 23/01* (2006.01)

(52) U.S. Cl.
CPC ..... *E21B 43/112* (2013.01); *E21B 23/01* (2013.01)

(58) Field of Classification Search
None
See application file for complete search history.

(56) References Cited

U.S. PATENT DOCUMENTS

| | | | | |
|---|---|---|---|---|
| 1,910,851 | A * | 5/1933 | Moss | E21B 43/112 166/55.2 |
| 2,526,695 | A * | 10/1950 | Schlumberger | E21B 33/138 166/100 |
| 2,638,801 | A * | 5/1953 | Klaasen | E21B 43/112 166/237 |
| 3,720,262 | A * | 3/1973 | Grable | E21B 19/00 166/298 |
| 9,303,494 | B2 * | 4/2016 | Pasvandi | E21B 29/06 |
| 2003/0075316 | A1 | 4/2003 | Marsh et al. | |
| 2003/0136562 | A1 | 7/2003 | Robison et al. | |
| 2005/0016727 | A1 | 1/2005 | Fields | |
| 2009/0194277 | A1 | 8/2009 | Burnett et al. | |
| 2009/0218097 | A1 | 9/2009 | Cook | |

OTHER PUBLICATIONS

International Search Report and Written Opinion dated Jul. 20, 2014, issued in corresponding application No. PCT/US2013/068027, 3pgs.

* cited by examiner

*Primary Examiner* — Shane Bomar
(74) *Attorney, Agent, or Firm* — Chamberlain Hrdlicka

(57) ABSTRACT

Methods and apparatus are presented for mechanically perforating a tubular positioned in a subterranean wellbore. A plurality of punch members are moved radially outward in response to hydraulic pressure from the tubing or other source into contact with the tubular. Retraction of the punch members is by biasing member or change in hydraulic pressure. A slip assembly, also hydraulically actuated, secures the tool in position during use.

20 Claims, 4 Drawing Sheets

HYDRAULIC TUBING PERFORATOR

CROSS-REFERENCE TO RELATED APPLICATIONS

None.

TECHNICAL FIELD

This disclosure relates to a downhole perforator assembly positioned at a target location in a well for mechanically perforating a tubular in a subterranean well.

BACKGROUND

In the process of establishing an oil or gas well, the well is typically provided with an arrangement for selectively establishing fluid communication between the interior of a tubular string, such as a casing, a liner, a tubing or the like and the annulus surrounding the tubular string. One method for establishing such communication is through the use of explosives, such as shaped charges, to create one or more openings through the tubular string. The shaped charges typically include a housing, a quantity of high explosive and a liner. In operation, the openings are made by detonating the high explosive which causes the liner to form a jet of particles and high pressure gas that is ejected from the shaped charge at very high velocity. The jet is able to penetrate the tubular string, thereby forming an opening.

The process of perforating through the casing dissipates a substantial portion of the energy from the explosive perforating device and the formation receives only a minor portion of the perforating energy. Further, explosives create high-energy plasma that can penetrate the wall of the adjacent casing, cement sheath outside the casing, and the surrounding formation rock to provide a flow path for formation fluids. Unfortunately, the act of creating a perforation tunnel may also create some significant debris and due to the force of the expanding plasma jet and drive some of the debris into the surrounding rock thereby plugging the newly created flow tunnel.

Moreover, as hydrocarbon producing wells are located throughout the world, it also has been found that certain jurisdictions discourage or even prohibit the use of such explosives. In these jurisdictions and in other locations where it is not desirable to use explosives, mechanical perforators have been used to establish communication between the interior of a tubular string and the surrounding annulus.

BRIEF DESCRIPTION OF THE DRAWINGS

For a more complete understanding of the features and advantages of the present disclosure, reference is now made to the detailed description of the disclosure along with the accompanying figures in which corresponding numerals in the different figures refer to corresponding parts and in which.

Figure 1:
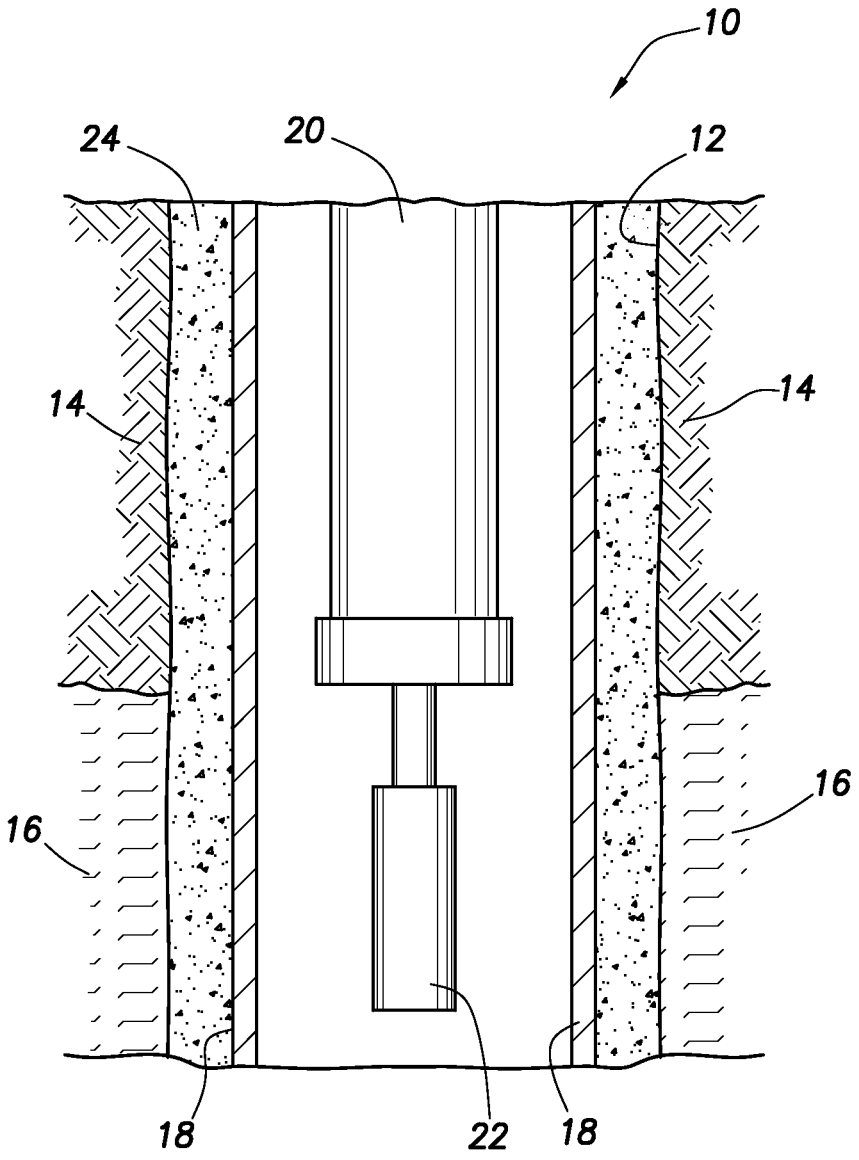
FIG. 1 is an elevational, cross-sectional schematic of a downhole portion of a cased well.

It should be understood by those skilled in the art that the use of directional terms such as above, below, upper, lower, upward, downward and the like are used in relation to the illustrative embodiments as they are depicted in the figures. Where this is not the case and a term is being used to indicate a required orientation, the specification will make such clear. Upstream, uphole, downstream and downhole are used to indicate location or direction in relation to the surface, where upstream indicates relative position or movement towards the surface along the wellbore and downstream indicates relative position or movement further away from the surface along the wellbore, unless otherwise indicated.

Even though the methods herein are discussed in relation to a vertical well, it should be understood by those skilled in the art that the system disclosed herein is equally well-suited for use in wells having other configurations including deviated wells, inclined wells, horizontal wells, multilateral wells and the like. Accordingly, use of directional terms such as "above", "below", "upper", "lower" and the like are used for convenience. Also, even though the discussion refers to a surface well operation, it should be understood by those skilled in the art that the apparatus and methods can also be employed in an offshore operation.

DETAILED DESCRIPTION

The present disclosures are described by reference to drawings showing one or more examples of how the disclosures can be made and used. In these drawings, reference characters are used throughout the several views to indicate like or corresponding parts. In the description which follows, like or corresponding parts are marked throughout the specification and drawings with the same reference numerals, respectively. The drawings are not necessarily to scale and the proportions of certain parts have been exaggerated to better illustrate details and features of the disclosure. In the following description, the terms "upper", "upward", "lower", "below", "downhole", "longitudinally", "axially" and the like, as used herein, shall mean in relation to the bottom, or furthest extent of, the surrounding wellbore even though the wellbore or portions of it may be deviated or horizontal. Correspondingly, the "transverse" or "radial" orientation shall mean the orientation perpendicular to the longitudinal or axial orientation. In the discussion which follows, generally cylindrical well, pipe and tube components are assumed unless expressed otherwise.

FIG. 1 shows a portion of hydrocarbon well 10. Wellbore 12 extends through formation 14 having at least one producing, or hydrocarbon bearing, zone 16. To avoid communication with non-producing zones, wellbores are typically cased, such as with tubular 18 such as a casing string, a liner string, a tubing string or the like. In the illustrated wellbore 12, a work string 20 has been run in, including tool subassembly 22, which may house various well tools, including the mechanical perforator of the present disclosure. In the illustrated embodiment, tubular 18, previously installed, is positioned within wellbore 12 such that an annular space 24 is formed between tubular 18 and wellbore 12. To allow flow from the surrounding formation and particularly the hydrocarbon bearing zone 16, a communication path such as tubular passageway or perforation must be established between the interior of tubular 18 and annulus 24. The figures herein are not to scale.

Figure 2:
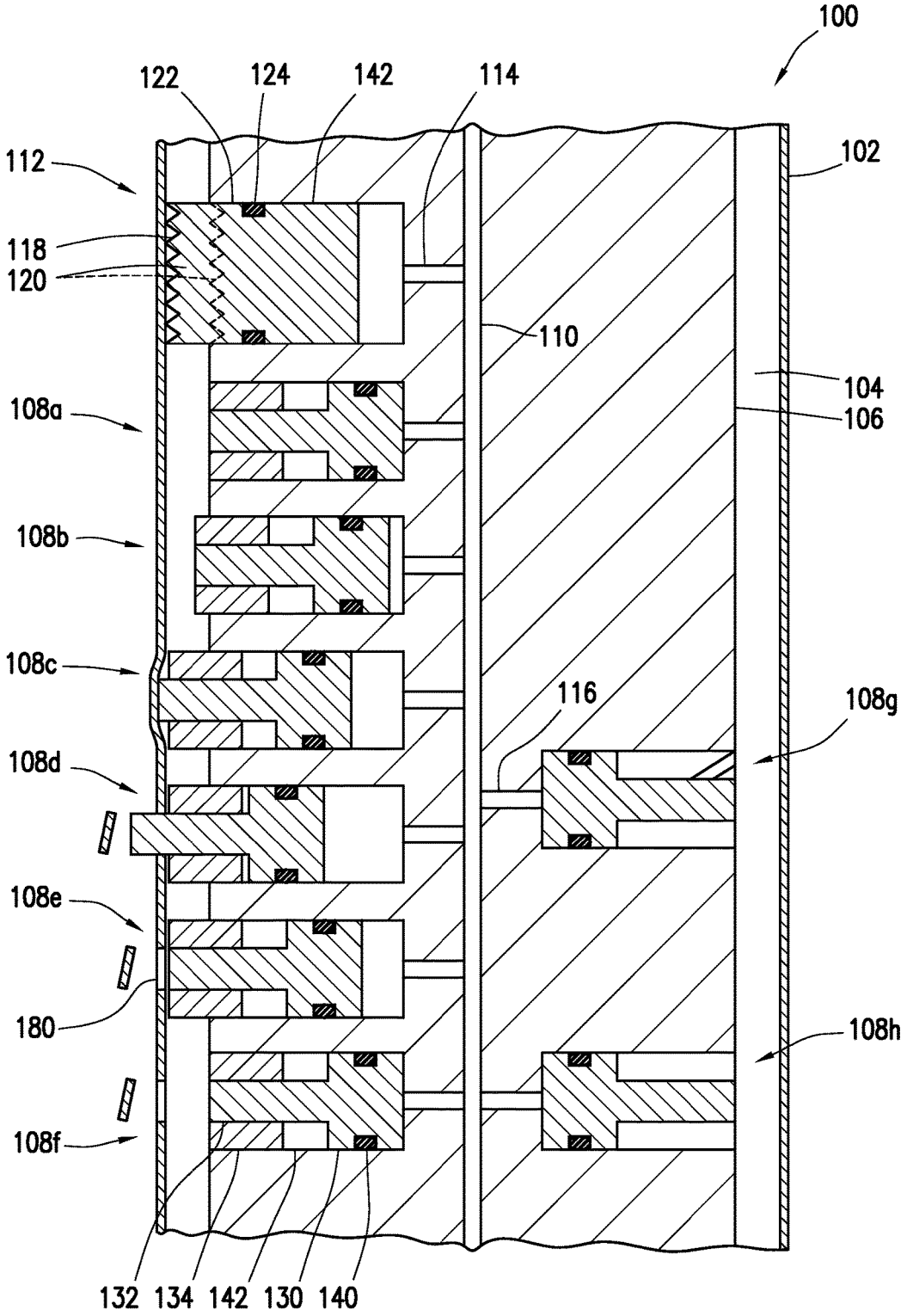
FIG. 2 is a partial, elevational, cross-sectional schematic of an exemplary mechanical perforator tool according to an aspect of the disclosure.

FIG. 2 is a partial, cross-sectional view of an exemplary embodiment of a hydraulic perforator tool according to an aspect of the disclosure. A downhole, hydraulically actuated, mechanical perforator tool is shown, generally designated 100, positioned in a downhole tubular 102, such as a tubing or casing. Downhole perforator tool 100 has been lowered into the downhole tubular 102 on a conveyance, such as by wireline, a slickline, coiled tubing, jointed tubing, or the like. The tool is operated by hydraulic power. Hydraulic input can be from a hydraulic conduit run-in for that purpose from the surface, especially where the tool is lowered on a wire line, slick line, or the like. Alternately, such as when the tool is lowered on a tubing string, coiled tubing, or the like, hydraulic pressure can be conveyed to the tool by increasing tubing pressure. A downhole power unit and actuator, such as a piston assembly, can alternately be used.

An annulus 104 is defined between the tool 100 and the tubing 102. The clearance between the tool and tubing can vary; however, it is preferable to minimize clearance, while still allowing trouble-free running-in of the tool, such that the required radial movement of the gripping assembly and perforators is minimized. Further, the tool exterior, or a sub attached to the tool, can define a profile for cooperation with a landing nipple or the like in some embodiments.

Downhole perforator tool comprises a perforator body 106 having at least one penetrator assembly 108*a-h* mounted therein. Within the tool body 106, one or more hydraulic passages 110 are defined. The hydraulic passages 110 convey hydraulic pressure to the gripping assembly 112, via a supply passageway 114, and to the perforator assemblies 108, via a plurality of supply passageways 116. As explained above, the hydraulic passages can be supplied with hydraulic pressure from a hydraulics line from the surface, a downhole hydraulic power unit, or via tubing pressure. The specific layout of the hydraulic passageways can be varied, as those of skill in the art will recognize. For example, fluid pressure can be communicated directly from an intersecting passage 110. Further, in the preferred embodiment shown, the hydraulic source for the gripping assembly and penetrator assemblies is the same, but multiple hydraulic pressure sources can be employed if desired.

The gripping assembly 112 is seen in FIG. 2 in a radially expanded position or actuated position wherein the gripping element 118 is in gripping engagement with the tubing 102. The gripping assembly serves to anchor the tool in position during the hydraulic perforation operation. The assembly includes a gripping element or elements 118, a piston 120 slidably mounted in a bore 122 defined in the tool body 106, a piston seal 124, and various other elements (not shown) that those of skill in the art will recognize, such as retaining devices, cooperating shoulders, biasing elements, etc. In a run-in or retracted position, shown by dotted line, the gripping assembly piston and gripping elements are radially retracted into the tool, preferably with the gripping elements flush with or countersunk with respect to the tool body exterior.

When the tool is positioned in the wellbore, hydraulic pressure is applied through passageways 110 and 114 to the piston 120. The piston is forced radially outward into the tubing wall and held in place by continued hydraulic pressure. Upon completion of perforations at that position in the wellbore, the piston is retracted to its run-in position by reducing the hydraulic pressure application. The piston can be biased, such as by a spring, towards the run-in position. Further, it is possible to retract, partially or fully, the piston by applying a differential pressure across the piston with the annulus 104 having the high-side pressure. Only a single gripping assembly is seen in FIG. 2, however, in practice, multiple assemblies are employed spaced circumferentially about the tool body.

Retraction of the gripping assembly is accomplished by reducing hydraulic pressure at the passages 110 and 114. Note that the gripping assembly and perforator assemblies are radially extended, preferably in that order, during the perforating operation, and in the reverse order during retraction to the run-in position. Since a higher pressure differential is required to radially extend the perforator assemblies, upon reduction of hydraulic pressure in the interior passages, the perforator assemblies should typically begin retraction prior to the gripping assembly beginning retraction. (It is understood that in certain embodiments or under certain operating conditions, the order of beginning or completing retraction may vary, such as if a penetrator assembly is stuck after perforation, etc., if differential pressure from the annulus is necessary to fully retract the gripping assembly but not the biased perforator assemblies, etc.) Upon continued reduction of hydraulic pressure, including to balanced differential pressure across the gripping assembly, or application of differential pressure from the annulus 104, the gripping assembly retracts into the bore 142. Biasing elements can be added to the gripping assembly, such as are known in the art, to bias the gripping assemblies towards the radially expanded or retracted position.

The gripping assembly shown is a simplified schematic and only one of various alternate ways to provide the gripping or anchoring function. Anchoring, gripping, and sealing assemblies are widely known in the art and those of skill will recognize the applications of the known designs to the present disclosure. The gripping assembly shown is not designed to provide a pressure seal in the annulus 104. Such a sealing role is possible, although not necessary. If an annular seal is formed at the gripping assembly, it may be desirable to locate the gripping assembly downhole from the penetrator assemblies to allow use of pressure differential to fully retract the gripping assembly piston 120 and/or the penetrator bushings or pistons. The gripping assembly can be located uphole from, downhole from, between a plurality of penetrator assemblies or any combination thereof. Further, the gripping assembly can be positioned on a separate tool attached above or below the tool 100. Anchoring and gripping assemblies can be used which employ slips, teeth, embedded teeth in the slips, hardened gripping elements, etc. Although not preferred, the tool can be run in conjunction with mechanically operated gripping elements which are set by placing weight down, pulling, or otherwise manipulating the tubing string, or by downhole power unit, etc.

Figure 3:
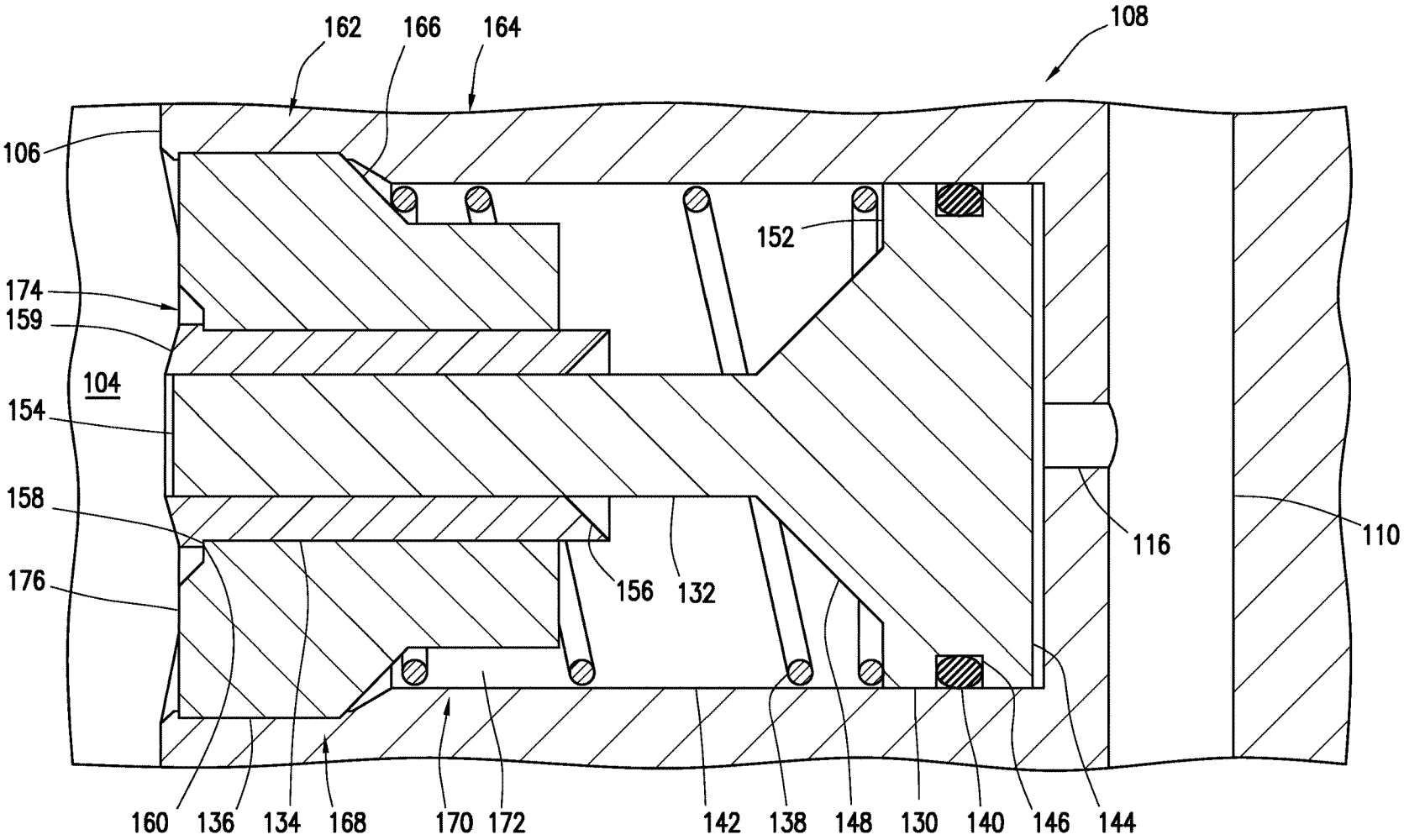
FIG. 3 is a detail, cross-sectional schematic of an exemplary penetrating assembly according to an aspect of the disclosure.
Figure 4:
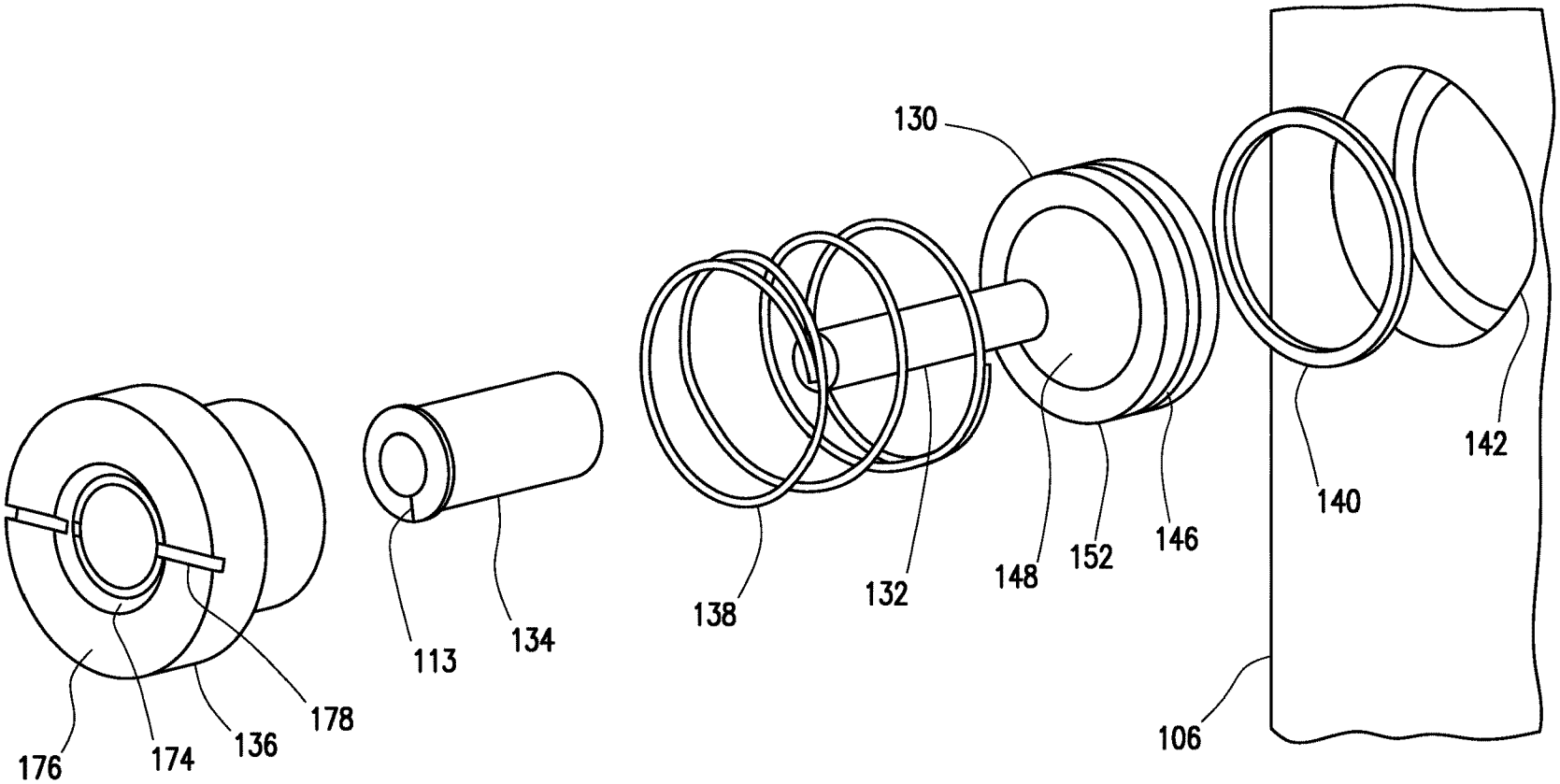
FIG. 4 is an exploded view of the exemplary penetrator assembly according to FIG. 3 and as disclosed herein.

FIG. 2 shows a plurality of exemplary penetrator assemblies 108*a-h* schematically, in simplified form, and with the assemblies in various positions, for purposes of discussion. It is understood that the penetrator assemblies will be operated simultaneously, near-simultaneously, or in a predetermined order of operation. FIG. 3 is a cross-sectional, elevation schematic of an exemplary penetrator assembly according to an aspect of the disclosure. The assemblies of FIGS. 2 and 3 vary in their details. FIG. 4 is an exploded, orthogonal schematic of an the exemplary penetrator assembly of FIG. 3. The penetrator assembly is discussed with reference to FIGS. 2-4.

An exemplary penetrator assembly 108 is seen in FIGS. 3-4 having a piston 130, punch member 132, sleeve 134, bushing 136, biasing member 138, and seal 140, positioned in a countersunk bore 142 in the tool body. The bore 142 is in fluid communication with hydraulic passages 116 and 110.

The piston 130 has a base portion providing an actuating surface 144 on which the hydraulic pressure from the hydraulic passages acts, a circumferential groove 146 for the seal 140, a shaped surface 148 for cooperating with the sleeve 134, a radially extending punch member 132 for penetrating the tubing, and a shoulder 152 to cooperate with the biasing member 138. The shaped surface can be sloped, conical, frustoconical, pyramidal, or otherwise shaped to cooperate with the sleeve. The base, shaped portion, and punch member can be monolithic or assembled. The punch is made of material sufficiently strong enough to repeatedly punch through the tubing wall without significant damage. The punch member can be hardened, have a hardened punching surface 154, an angled or ridged punching surface, etc.

The sleeve 134 is preferably a hollow cylindrical member, slidably movable on the punch member 132 and positioned inside the bore 142. The sleeve has a sloped, conical, frustoconical, pyramidal, or otherwise shaped bottom surface 156 which cooperate with the shaped surface 148 of the piston. At the radially outward end of the sleeve, a shoulder 158 is defined for cooperation with a corresponding shoulder 160 defined on the bushing 136. In a preferred embodiment, the punch member 132 is flush with or countersunk in relation to the outward end of the sleeve, as shown. The sleeve can be made of metal, plastic, etc.

The bushing 136 is mounted such as by threads, in the bore 142 defined in the tool. The bushing is generally cylindrical and has radially enlarged and reduced portions to cooperate with shoulders and other assembly elements. The bushing includes a radially enlarged portion 162 at its radially outward end, a radially reduced portion 164 at its radially inward end, and a connecting shoulder 166 extending between the portions 162 and 164. The radially enlarged portion 162 is mounted in a corresponding enlarged bore portion 168. The radially reduced portion 164 of the bushing is mounted within a corresponding radially reduced bore portion 170. A clearance annulus 172 is defined between the radially reduced portions of the bore and bushing to receive one end of the biasing member 138. The shoulder 166 acts as a support for the biasing member 138.

The bushing defines a shoulder 160, to cooperate with the sleeve shoulder 158, which is part of a countersunk annular recess 174 on the radially outward face 176 of the bushing. The bushing can be made of metal, plastic, or otherwise.

The biasing member 138 can be a spring, as shown, or any other resilient or elastic element as known in the art. The biasing member 138 is seated on the piston shoulder 152 at one end and on the bushing shoulder 166 of the bushing. The outward end of the biasing member can be held in position in the clearance annulus 172. The biasing member biases the piston away from the bushing. FIG. 3 shows the biasing member in a relaxed position.

The annulus 104 and bore 142 are in fluid communication such that fluid pressure from the annulus acts on the shoulder 152 and shaped face 148 and the piston 130. Such communication can be achieved through the annular space between punch member, sleeve, and bushing, or along passageways such as passageway 113.

The piston is seen in a run-in or retracted position in FIG. 3. FIG. 2 provides illustrations of the assembly at various stages during operation. In use, the tool is positioned at a desired downhole location. The location can, but is not required to, be defined by a landing nipple, tubing profile, or other positioning mechanism. The tool can also be axially rotated to a desired orientation in some embodiments. This may be particularly useful where all punch members are aligned in a single orientation due to space and size limitations of the wellbore, tool, tubing annulus, or desired penetration depth.

Once in location, hydraulic pressure is applied through the passages 110, 114, and 116. The gripping assembly and its elements are sized to actuate at a lower hydraulic differential pressure than the penetrator assemblies. The piston sizes and retraction biasing element forces are selected such that the slips engage before and release after the punch members. Consequently, the gripping assembly is actuated initially. Hydraulic pressure forces the gripping assembly piston 120 radially outward and into gripping contact with the tubing 102. Gripping elements 118, such as teeth, are designed to "bite" into the tubing to assist in maintain the tool in position in the tubing. The tool is held in a selected longitudinal position or location in the well and in a selected rotational position or orientation during operation to prevent relative rotation between the tool body and punch or other tool members. Additional gripping assemblies can be used.

The penetrator assemblies 108 are initially in a run-in position, seen in FIG. 3 and at the upper assembly 108*a* in FIG. 2. The penetrator assemblies are actuated by increasing hydraulic pressure through the passages 110 and 116. Note that the application of the initial hydraulic pressure to set the gripping assembly can also force outward movement in the penetrator assemblies, even as far as to contact with the tubular. For example, see assembly 108*b* in FIG. 2. However, the actuation force to penetrate the tubular is provided by a higher hydraulic pressure application.

Hydraulic pressure drives the penetrator piston 130 outward by acting on surface 144. As the piston is driven radially outwardly, the biasing member 138, seated on the piston shoulder 152, compresses against the bushing 136.

The piston, sleeve, and punch member are driven outward and into contact with the tubing 104 as seen in assembly 108*c* in FIG. 2. The face 159 of the sleeve 134 preferably contacts the downhole tubular. The piston 130 continues to move radially outward, sliding within the sleeve, compressing the biasing member 138, and driving the punch member 132 into the tubing 104. The piston continues outward movement until the cooperating shaped surfaces 148 and 156 of the piston and sleeve, respectively, contact one another. At this point, the punch member 132 has been forced through the tubing and created a perforation, as best seen at assembly 108*d* in FIG. 2.

After perforation, hydraulic pressure is reduced in passages 110 and 116, allowing the piston 130 to retract under the force of the biasing member 138. The punch member 132 is withdrawn from the tubing, leaving behind a perforation, and the piston moves radially inwardly in the bore 142. Hydraulic differential pressure across the piston 130, with high-side pressure in the annulus 104 and the outward surface of the piston, can also be used to drive the piston away from the tubing or the remaining distance to the run-in or retracted position, as best seen at assembly 108*f* in FIG. 2. In the preferred embodiment shown, creating a pressure differential across the piston by pressuring up on the annulus, or down in the tubing, forces piston inward to the retracted position.

Alternate mechanisms can be employed to retract the piston either partially or fully into the bore. For example, an additional biasing member can be placed to bias the piston with respect to the tool body. In such a case, the biasing member would preferably seat on the base of the piston and a shoulder defined in the tool body and provide additional retraction force biasing the piston to the run-in position. Persons of skill in the art will recognize additional ways to bias the elements to the run-in position or to provide for additional application of force for retraction.

The assembly, such as seen in FIG. 2, is not required to employ a bushing as the tool can be designed to maintain the assembled piston, sleeve, and spring in position. The sleeve is also not required, but has been found advantageous in protecting and guiding the punch member.

In the illustrated embodiment, a plurality of penetrators are provided in the tool so that a single actuation of the tool will result in a plurality of perforations. The arrangement of the perforator assemblies can vary. For example, assemblies can be oriented in diametrically opposed pairs, as with assemblies 108*f* and 108*h*, in radially opposed and axially staggered pairs, as with assemblies 108*d* and 108*g*, or any other desired arrangement. Further, the assemblies can be arranged in various angular orientations. For example, three sets of perforator assemblies can be oriented spaced apart at 120 degrees, four sets at 90 degrees, etc.

Restrictions of tubing size, required perforation depth, etc., may require that the punches be of the same orientation. In this case, an indexing feature can be used to create perforations at other angular orientations. For instance, the tool, the punch assemblies within the tool, or the tubing string can be rotated to perforate the surrounding tubular at another orientation. The tool can be raised or lowered along the wellbore to provide perforations along any given length.

The system can be run on wireline or similar and hydraulically actuated. The perforator tool is preferably attached to a locating device or tool, such as the commercially available Otis X or R (trade name) type locking mandrel. The lock is set in the landing nipple at the desired location using standard and well-known wireline methods. The running tool used to set the locating device is retrieved. Hydraulic pressure is applied to the tubular to perform the perforating operation. The lock and perforator tool can be retrieved or the lock can be re-set with related equipment at additional landing nipples and the process repeated. It is also possible to attach a spacer extension tube between the lock and perforator and use the same landing nipple repeatedly.

The following disclosure is provided in support of the methods claimed or which may be later claimed. Specifically, this support is provided to meet the technical, procedural, or substantive requirements of certain examining offices. It is expressly understood that the portions or actions of the methods can be performed in any order, unless specified or otherwise necessary, that each portion of the method can be repeated, performed in orders other than those presented, that additional actions can be performed between the enumerated actions, and that, unless stated otherwise, actions can be omitted or moved. Those of skill in the art will recognize the various possible combinations and permutations of actions performable in the methods disclosed herein without an explicit listing of every possible such combination or permutation. It is explicitly disclosed and understood that the actions disclosed, both herein below and throughout, can be performed in any order (xyz, xzy, yxz, yzx, etc.) without the wasteful and tedious inclusion of writing out every such order. Methods of mechanically perforating a downhole tubular positioned in a subterranean wellbore, are disclosed, wherein exemplary methods comprise: running a mechanical perforator tool into the downhole tubular in the wellbore at a selected location, an annulus defined between the perforator tool and the downhole tubular; applying hydraulic pressure to act on a plurality of punch members movably mounted in the perforator tool; moving the plurality of punch members, in response to the hydraulic pressure, into contact with the downhole tubular; perforating the downhole tubular using the plurality of punch members; reducing hydraulic pressure acting on the plurality of punch members; and moving the plurality of punch members away from the downhole tubular. Additional actions which can be added, substituted, performed in various orders, or omitted, include, but are not limited to: setting at least one gripping assembly to maintain the perforator tool in the selected location; wherein the gripping assembly comprises at least one toothed slip, extending the at least one slip radially outward into gripping contact with the downhole tubular; applying a hydraulic pressure to act on the at least one slip; wherein the at least one gripping assembly is positioned on the perforator tool; applying a hydraulic pressure to actuate the at least one gripping assembly; maintaining at least a minimum application of hydraulic pressure to the at least one gripping assembly during operation of the plurality of punch members of the perforator tool; biasing the plurality of punch members towards a radially retracted position; wherein the plurality of punch members are mounted on a plurality of corresponding, pistons mounted slidably in the perforator tool and wherein applying hydraulic pressure to the plurality of punch members comprises applying hydraulic pressure directly to the plurality of corresponding pistons; moving the plurality of punch members away from the downhole tubular at least partially in response to reducing hydraulic pressure acting on the punch members; moving the plurality of punch members away from the downhole tubular at least partially in response to biasing the punch members; the punch members slidable along radial paths between radially extended positions and radially retracted positions; unsetting the at least one gripping assembly; moving the perforator tool to one or more new locations in the downhole tubular and perforating the downhole tubular at the one or more new locations; applying annular hydraulic pressure in the annulus between the perforator tool and the downhole tubing; moving the plurality of punch members radially inward at least partially in response to applying the annular hydraulic pressure; moving a plurality of bushings, corresponding to the plurality of punch members, in response to the application of annular hydraulic pressure; applying hydraulic pressure by increasing the tubing pressure in the wellbore.

In various modes of operation, the tool can be run-in to on a wire line, slick line, tubing string, etc. The tool can be landed on a landing nipple or other profile. The tool can be flowed or pumped downhole. The tool or portions thereof can be retrieved to the surface. The tool can be manipulated downhole by manipulation of the tubing string or other conveyance. The process can be repeated as needed.

While this disclosure has been described with reference to illustrative embodiments, this description is not intended to be construed in a limiting sense. Various modifications and combinations of the illustrative embodiments as well as other embodiments of the disclosure will be apparent to persons skilled in the art upon reference to the description. It is, therefore, intended that the appended claims encompass any such modifications or embodiments.

It is claimed:

1. A method of mechanically perforating a downhole tubular positioned in a subterranean wellbore, the method comprising:

running a mechanical perforator tool into the downhole tubular in the wellbore at a selected location, an annulus defined between the perforator tool and the downhole tubular;

applying a first hydraulic pressure through a hydraulic circuit to act on at least on gripping assembly;

moving the at least on gripping assembly, in response to the first hydraulic pressure, into gripping contact with the downhole tubular;

applying a second hydraulic pressure through the hydraulic circuit to act on a plurality of punch members movably mounted in the perforator tool, wherein the second hydraulic pressure is greater than the first hydraulic pressure;

moving the plurality of punch members, in response to the second hydraulic pressure, into contact with the downhole tubular;

perforating the downhole tubular using the plurality of punch members;

reducing hydraulic pressure below the second hydraulic pressure and above the first hydraulic pressure;

moving the plurality of punch members away from the downhole tubular;

reducing hydraulic pressure below the first hydraulic pressure; and moving the at least one gripping assembly away from the downhole tubular.

2. The method of claim 1, wherein the gripping assembly comprises at least one toothed slip.

3. The method of claim 1, wherein the at least one gripping assembly is positioned on the perforator tool.

4. The method of claim 1, further comprising maintaining at least the first hydraulic pressure to the at least one gripping assembly during operation of the plurality of punch members of the perforator tool.

5. The method of claim 1, further comprising biasing the plurality of punch members towards a radially retracted position.

6. The method of claim 1, wherein the plurality of punch members are mounted on a plurality of corresponding pistons mounted slidably in the perforator tool and wherein applying hydraulic pressure to the plurality of punch members comprises applying hydraulic pressure directly to the plurality of corresponding pistons.

7. The method of claim 1, further comprising moving the plurality of punch members away from the downhole tubular at least partially in response to reducing hydraulic pressure acting on the punch members.

8. The method of claim 5, further comprising moving the plurality of punch members away from the downhole tubular at least partially in response to biasing the punch members.

9. The method of claim 1, wherein the punch members are slidable along radial paths between radially extended positions and radially retracted positions.

10. The method of claim 1, further comprising subsequently moving the perforator tool to one or more new locations in the downhole tubular and perforating the downhole tubular at the one or more new locations.

11. The method of claim 1, further comprising applying an annular hydraulic pressure in the annulus between the perforator tool and the downhole tubing.

12. The method of claim 11, further comprising moving the plurality of punch members radially inward at least partially in response to applying the annular hydraulic pressure.

13. The method of claim 12, further comprising moving a plurality of bushings, corresponding to the plurality of punch members, in response to the application of annular hydraulic pressure.

14. The method of claim 1, further comprising applying hydraulic pressure by increasing the tubing pressure in the wellbore.

15. A downhole, hydraulically actuated, mechanical perforator for perforating downhole tubulars in a wellbore extending through a subterranean formation, the perforator comprising:

a tool housing;

a plurality of punch members slidably mounted in the housing for movement between a radially retracted position and a radially extended position;

a hydraulically actuable gripping assembly for grippingly engaging the downhole tubular;

a hydraulic circuit defined in the tool housing, and in hydraulic communication to actuate the plurality of punch members and the hydraulically actuable gripping assembly, wherein a first pressure in the hydraulic circuit actuates the hydraulically actuable gripping assembly and a second pressure in the hydraulic circuit actuates the plurality of punch members, wherein the second pressure is greater than the first pressure.

16. The perforator of claim 15, further comprising a plurality of biasing members positioned to bias the plurality of punch members towards the radially retracted position.

17. The perforator of claim 15, wherein the plurality of punch members extend from a corresponding plurality of hydraulically actuated pistons, the pistons in hydraulic communication with the hydraulic circuit.

18. The perforator of claim 15, further comprising a plurality of bushings, slidably mounted in a corresponding plurality of bores defined in the tool housing, the plurality of punch members slidably positioned in the corresponding plurality of bushings.

19. The perforator of claim 18, wherein the bushings have radially outward faces having fluid communication features for communicating annular fluid pressure to the outward faces.

20. The perforator of claim 19, wherein the features include at least one of an annular recess or a radial groove.

* * * * *